US007328461B2

(12) United States Patent
Lewis et al.

(10) Patent No.: US 7,328,461 B2
(45) Date of Patent: Feb. 12, 2008

(54) PROTECTIVE TROUSERS HAVING GUSSETED FLY

(75) Inventors: Patricia K. Lewis, Tipp City, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 80 days.

(21) Appl. No.: 11/067,201

(22) Filed: Feb. 24, 2005

(65) Prior Publication Data

US 2006/0185064 A1 Aug. 24, 2006

(51) Int. Cl.
*A41F 9/00* (2006.01)

(52) U.S. Cl. ..... 2/234; 2/457

(58) Field of Classification Search ..... 2/69, 2/79, 81, 217–221, 405, 227, 228, 234–238, 2/311, 338, 2.17, 456, 457, 458
See application file for complete search history.

(56) References Cited

U.S. PATENT DOCUMENTS 666,246 A * 1/1901 Henderson ..... 2/237
1,086,685 A * 2/1914 Morton ..... 2/235
3,149,343 A * 9/1964 Jacobson ..... 2/235
4,068,321 A * 1/1978 Chayer ..... 2/227
4,768,233 A * 9/1988 Grilliot et al. ..... 2/81
4,887,317 A * 12/1989 Phillips et al. ..... 2/458
5,036,548 A * 8/1991 Grilliot et al. ..... 2/81
5,136,724 A * 8/1992 Grilliot et al. ..... 2/81
5,157,790 A * 10/1992 Aldridge ..... 2/227
5,247,708 A * 9/1993 Freese, Jr. ..... 2/79
5,402,539 A * 4/1995 Hewitt ..... 2/227
5,613,247 A * 3/1997 Bowman ..... 2/81
6,199,215 B1 * 3/2001 Biggerstaff ..... 2/234
6,687,913 B2 * 2/2004 Aldridge ..... 2/81
6,868,558 B2 * 3/2005 Majerfeld ..... 2/96
6,880,175 B2 * 4/2005 Tajima et al. ..... 2/237
2004/0006815 A1 * 1/2004 Carroll et al. ..... 2/457
2005/0034220 A1 * 2/2005 Diamond ..... 2/234
2005/0229292 A1 * 10/2005 Watkins et al. ..... 2/227

* cited by examiner

*Primary Examiner*—Alissa Hoey
(74) *Attorney, Agent, or Firm*—Wood, Phillips, Katz, Clark & Mortimer

(57) ABSTRACT

In a pair of protective trousers having a fly, in which a flap extending from a first edge of a torso-covering portion covers a second edge thereof in a closed condition of the fly but not in an opened condition of the fly and in which the first and second edges are secured releasably to each other, as by a hook-and-loop fastener, in the closed condition, a gusset extends along and between the first and second edges, in the opened and closed conditions.

14 Claims, 1 Drawing Sheet

PROTECTIVE TROUSERS HAVING GUSSETED FLY

STATEMENT REGARDING FEDERALLY SPONSORED RESEARCH OR DEVELOPMENT

This invention was made with Government support under Contract No. W91CRB-04-C-027 awarded by the United States Department of the Army. The Government has certain rights in the invention.

TECHNICAL FIELD OF THE INVENTION

This invention pertains to a pair of protective trousers for a firefighter or for an emergency rescue worker. This invention provides a gusset, which extends along and between two edges defining a fly in a torso-covering portion of the pair of protective trousers, in an opened condition of the fly and in a closed condition of the fly.

BACKGROUND OF THE INVENTION

Commonly, a pair of protective trousers for a firefighter or for an emergency rescue worker has an outer shell and a lining system, which may include an intermediate liner providing a moisture barrier, a chemical barrier, or both and which also may include an inner liner providing a thermal barrier.

Usually, a pair of protective trousers for a firefighter or for an emergency rescue worker has a torso-covering portion having a fly, which has a closed condition wherein a first edge of the torso-covering portion and a second edge of the torso-covering portion are secured releasably to each other, in which the first and second edges extend to an upper edge of the torso-covering portion, and which has an opened condition wherein the first and second edges are not secured to each other.

The torso-covering portion may have a flap, which extends from the first edge, which covers the second edge in the closed condition of the fly, and which does not cover the second edge in the opened condition of the fly. The torso-covering portion may have means exemplified by a waist fastener and by a hook-and-loop fastener, which has a hook-faced strip extending along a given one of the first and second edges and a loop-faced strip extending along the other one of the first and second edges, for securing the first and second edges releasably to each other in the closed condition of the fly. A waist fastener and a mechanical zipper having a first toothed strip extending along the first edge and a second toothed strip extending along the second edge may be alternatively used for securing the first and second edges releasably to each other in the closed condition of the fly.

Disadvantageously, in the opened condition of the fly, the pair of protective trousers does not protect a wearer against a hazardous liquid splashed or sprayed between the first and second edges of the torso-covering portion, against the wearer or against underclothes worn by the wearer.

SUMMARY OF THE INVENTION

This invention improves a pair of protective trousers for a firefighter or for an emergency rescue worker, as described above, by providing the torso-covering portion with a gusset, which extends along and between the first and second edges, in the opened and closed conditions of the fly. The torso-covering portion may have a flap, which extends from the first edge, which covers the second edge in the closed condition of the fly, and which does not cover the second edge in the opened condition of the fly.

The torso-covering portion may have means for securing the first and second edges releasably to each other in the closed condition of the fly. The securing means may comprise a two-part fastener, such as a hook-and-loop fastener or a mechanical zipper.

Preferably, the torso-covering portion has an outer shell and a lining system and the gusset has an outer shell, which is similar to the outer shell of the torso-covering portion, and a lining system, which is similar to the lining system of the torso-covering portion.

Preferably, therefore, the gusset has an outer shell and a lining system comprising a moisture barrier. Having a lining system comprising a moisture barrier, the gusset protects a wearer against a hazardous liquid splashed or sprayed between the first and second edges of the torso-covering portion of the pair of protective trousers.

BRIEF DESCRIPTION OF THE DRAWINGS

In FIG. 1, the fly is illustrated in a closed condition, in which a gusset provided by this invention is hidden.

DETAILED DESCRIPTION OF THE ILLUSTRATED EMBODIMENTS

Figure 1:
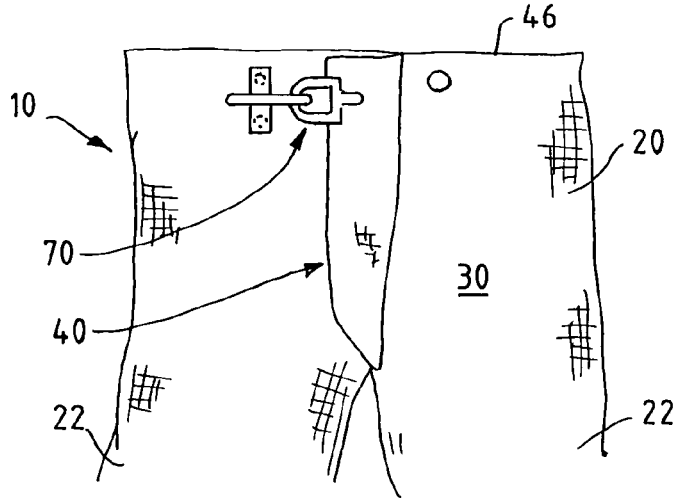
FIG. 1 is a partly broken away, front views of a pair of protective trousers having a fly, which includes a hook-and-loop fastener.
Figure 2:
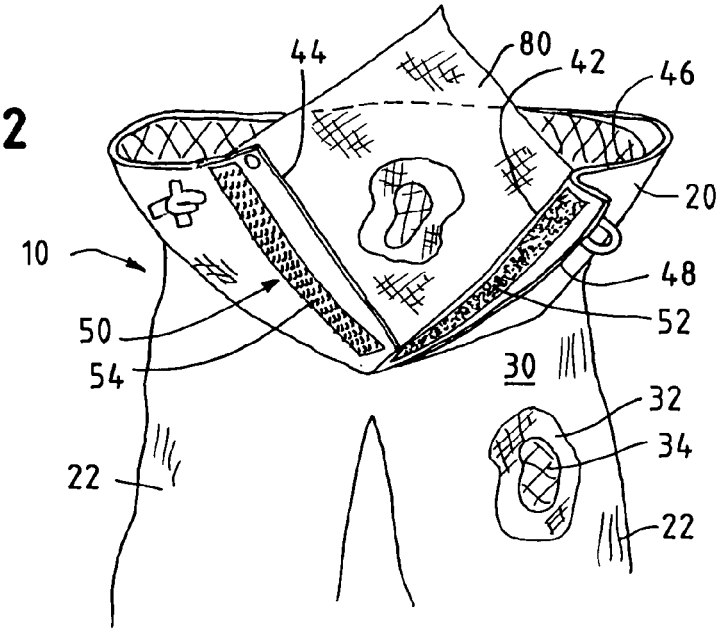
FIG. 2 is a similar view, in which the fly is illustrated in an opened condition revealing the gusset. Moreover, in FIG. 2, layers are broken away in small patches so as to reveal other layers.

As illustrated in FIGS. 1 and 2, a pair of protective trousers 10 for a firefighter or for an emergency rescue worker has a torso-covering portion 20, which covers the lower torso of a wearer when the pair of protective trousers 10 are worn, as well as two leg-covering portions 22, which extend downwardly from the torso-covering portion 12 so as to cover the legs of the wearer when the pair of protective trousers 10 is worn. Conventionally, the pair of protective trousers 10 has, both at the upper torso-covering portion 12 and at the leg-covering portions 14, an outer shell 30, an intermediate liner 32 providing a moisture barrier, a chemical barrier, or both, and an inner liner 34 providing a thermal barrier. In an alternative embodiment, which is not illustrated, the inner liner 34 is omitted.

The torso-covering portion 20 has a fly 40, which has a closed condition wherein a first edge 42 of the torso-covering portion 20 and a second edge 44 of the torso-covering portion 20 are secured releasably to each other, in which the first edge 42 and the second edge 44 extend to an upper edge 46 of the torso-covering portion 20, and which has an opened condition, in which the first edge 42 and the second edge 44 are not secured to each other. In the closed condition, a flap 48 extending from the first edge 42 covers the second edge 44. In the opened condition, the flap 48 does not cover the second edge 44. The torso-covering portion 20 has means for securing the first edge 42 and the second edge 44 releasably to each other in the closed condition of the fly 40.

Figure 3:
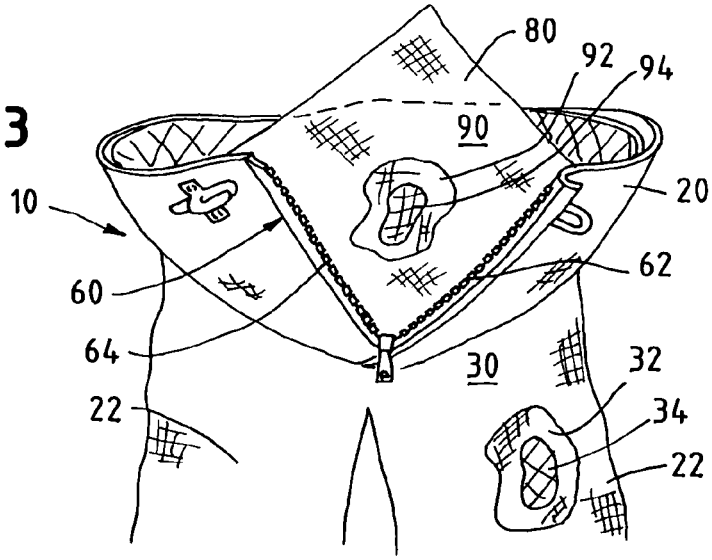
FIG. 3 is a similar view of another pair of protective trousers having a fly, which includes a mechanical zipper and which is illustrated in an opened condition.

Preferably, as illustrated in FIG. 2, the securing means comprises a hook-and-loop fastener 50, which also is conventional in protective trousers for firefighters and for emergency rescue workers. The hook-and-loop fastener 50 has a loop-faced strip 52, which is sewn to and along the first edge 42, and a loop-faced-strip 54, which is sewn to and along the second edge 44. Alternatively, as illustrated in FIG. 3, the securing means comprises a mechanical zipper 60, which also is conventional in protective trousers for firefighters and for emergency rescue workers. The mechanical zipper has a first toothed strip 62, which is sewn to and along the first edge 42, and a second toothed strip 64, which is sewn to and along the second edge. Another releasable fastening means, such as an array of snap fasteners or an array of buttons coating with buttonholes, can be alternatively used.

Additionally, whether the hook-and-loop fastener 50, the mechanical zipper 60, or another releasable fastening means is used, the securing means further comprises a waist-fastening means, such as a mechanical clasp 70, which is conventional in protective trousers for firefighters and for emergency rescue workers.

As provided by this invention, whether the hook-and-loop fastener 50 or the mechanical zipper 60 is used, a gusset 80 is sewn to the torso-covering portion 20 along the first and second edges 42, 44, so as to extend along and between the first and second edges 42, 44, in the opened and closed conditions of the fly 40. The gusset 80 has an outer shell 90, which is similar to the outer shell 30 described above, an intermediate liner 92, which is similar to the intermediate liner 32 described above, and an inner liner 94, which is similar to the inner liner 34 described above. In the simplified embodiment, in which the inner liner 34 is omitted, the inner liner 94 is omitted.

Advantageously, the gusset 80 protects a wearer against a hazardous liquid splashed or sprayed between the first and second edges 42, 44, of the torso-covering portion 20, against the wearer or against underclothes worn by the wearer.

The invention claimed is:

1. For a firefighter or for an emergency worker, a pair of protective trousers having an outer shell and a liner, the liner of the protective trousers providing at least one of a moisture barrier and a chemical barrier, the protective trousers further having a torso-covering portion having a fly, which has a closed condition wherein a first edge of the torso-covering portion and a second edge of the torso-covering portion are secured releasably to each other, in which each of the first and second edges have a length extending to an upper edge of the torso-covering portion, and which has an opened condition, wherein the first and second edges are not secured to each other, the torso-covering portion having a gusset which has a first end attached to the first edge and a second end attached to the second edge in the opened and closed conditions of the fly, the first and second ends extending and continuously connected along the length of the first and second edges, wherein the gusset has an outer shell and a liner, the liner of the gusset providing at least one of a moisture barrier and a chemical barrier.

2. For a firefighter or for an emergency worker, a pair of protective trouser having an outer shell and a liner, the liner of the protective trousers providing at least one of a moisture barrier and a chemical barrier, the protective trousers further having a torso-covering portion having a fly, which has a closed condition wherein a first edge of the torso-covering portion and a second edge of the torso-covering portion are secured releasably to each other and wherein a flap extending from the first edge covers the second edge, in which each of the first and second edges have a length extending to an upper edge of the torso-covering portion, and which has an opened condition wherein the first and second edges are not secured to each other and wherein the flap does not cover the second edge, the torso-covering portion having a gusset which has a first end attached to the first edge and a second end attached to the second edge in the opened and closed conditions of the fly, the first and second ends extending and continuously connected along the length of the first and second edges, wherein the gusset has an outer shell and a liner, the liner of the gusset providing at least one of a moisture barrier and a chemical barrier.

3. For a firefighter or for an emergency worker, a pair of protective trousers having an outer shell and a liner, the liner of the protective trousers providing at least one of a moisture barrier and a chemical barrier, the protective trousers further having a torso-covering portion having a fly, which has a closed condition wherein a first edge of the torso-covering portion and a second edge of the torso-covering portion are secured releasably to each other, in which each of the first and second edges have a length extending to an upper edge of the torso-covering portion, and which has an opened condition wherein the first and second edges are not secured to each other, the torso-covering portion having means for securing the first and second edges releasably to each other in the closed condition of the fly, the torso-covering portion having a gusset which has a first end attached to the first edge and a second end attached to the second edge in the opened and closed conditions of the fly, the first and second ends extending and continuously connected along the length of the first and second edges, wherein the gusset has an outer shell and a liner, the liner of the gusset providing at least one of a moisture barrier and a chemical barrier.

4. For a firefighter or for an emergency worker a pair of protective trousers having an outer shell and a liner, the liner of the protective trousers providing at least one of a moisture barrier and a chemical barrier, the protective trousers further having a torso-covering portion having a fly, which has a closed condition wherein a flap extending from a first edge of the torso-covering portion covers a second edge of the torso-covering portion, in which each of the first and second edges have a length extending to an upper edge of the torso-covering portion, and which has an opened condition wherein the flap does not cover the second edge, the torso-covering portion having means for securing the first and second edges releasably to each other in the closed condition of the fly, the torso-covering portion having a gusset which has a first end attached to the first edge and a second end attached to the second edge in the opened and closed conditions of the fly, the first and second ends extending and continuously connected along the length of the first and second edges, wherein the gusset has an outer shell and a liner, the liner of the gusset providing at least one of a moisture barrier and a chemical barrier.

5. The pair of protective trousers of claim 3 wherein the securing means comprises a two-part fastener, which has a first part extending along the first edge and which has a second part extending along the second edge.

6. The pair of protective trousers of claim 5 wherein the two-part fastener is a hook-and-loop fastener, one said part being a hook-faced part and the other part being a loop-faced part.

7. The pair of protective trousers of claim 5 wherein the two-part fastener is a mechanical zipper.

8. The pair of protective trousers of claim 4 wherein the securing means comprises a two-part fastener, which has a first part extending along the first edge and which has a second part extending along the second edge.

9. The pair of protective trousers of claim 8 wherein the two-part fastener is a hook-and-loop fastener, one said part being a hook-faced part and the other part being a loop-faced part.

10. The pair of protective trousers of claim 8 wherein the two-part fastener is a mechanical zipper.

11. The pair of protective trousers of claim 1 wherein the outer shell of the gusset is similar to the outer shell of the torso-covering portion and the liner of the gusset is similar to the liner of the torso-covering portion.

12. The pair of protective trousers of claim 2 wherein the gusset has an outer shell similar to the outer shell of the torso-covering portion and the liner of the gusset is similar to the liner of the torso-covering portion.

13. The pair of protective trousers of claim 3 wherein the gusset has an outer shell similar to the outer shell of the torso-covering portion and the liner of the gusset is similar to the liner of the torso-covering portion.

14. The pair of protective trousers of claim 4 wherein the gusset has an outer shell similar to the outer shell of the torso-covering portion and the liner of the gusset is similar to the liner of the torso-covering portion.

* * * * *